US005270477A

United States Patent [19]

Kawashima

[11] Patent Number: 5,270,477

[45] Date of Patent: Dec. 14, 1993

[54] AUTOMATIC PERFORMANCE DEVICE

[75] Inventor: Susumu Kawashima, Hamamatsu, Japan

[73] Assignee: Yamaha Corporation, Hamamatsu, Japan

[21] Appl. No.: 843,728

[22] Filed: Feb. 28, 1992

[30] Foreign Application Priority Data

Mar. 1, 1991 [JP] Japan ..... 3-059358

[51] Int. Cl.[5] ..... G10H 1/02; G10H 1/06; G10H 1/40; G10H 1/46

[52] U.S. Cl. ..... 84/622; 84/626; 84/633; 84/635; 84/636; 84/DIG. 12

[58] Field of Search ..... 84/609 ∝ 614, 84/622-638, DIG. 12, DIG. 22

[56] References Cited

U.S. PATENT DOCUMENTS 4,915,007 4/1990 Wachi et al. ..... 84/635 X

FOREIGN PATENT DOCUMENTS 63-193192 8/1988 Japan .
58211191 12/1989 Japan .

*Primary Examiner*—Stanley J. Witkowski

*Attorney, Agent, or Firm*—Spensley, Horn, Jubas & Lubitz

[57] ABSTRACT

Header control data for setting various characteristics of an automatic performance tone such as tone color, tone volume, tempo, effect and the like are stored in a header portion of a memory. The header control data are loaded into a buffer register, and various characteristics of an automatic performance tone to be generated are established on the basis of the header control data stored in the buffer register. In response to activation of a changing operator, the header control data in the buffer register are changed and a hence various characteristics of the automatic performance tone to be generated are changed. When the data in the buffer register is changed during an automatic performance, the header control data stored in the memory is changed in correspondence to the change. Therefore, during an automatic performance, various characteristics of the automatic performance tone can freely be changed while listening to the generated automatic performance tone, and also the header control data stored into the header portion of the memory can be automatically rewritten in correspondence to such change.

12 Claims, 6 Drawing Sheets

AUTOMATIC PERFORMANCE DEVICE

BACKGROUND OF THE INVENTION

This invention generally relates to an automatic performance device such as a sequencer, an automatic accompaniment performing device or an automatic rhythm performing device, and more particularly it relates to such an automatic performance device which has the capability of readily changing, even during an automatic performance, various kinds of setting data of, for example, tone color, tone volume, tempo, effects and the like to be implemented in the automatic performance.

An automatic performance device of the sequencer type which stores performance information received from the keyboard of an electronic musical instrument or a computer and then reproduces performance tones on the basis of the stored performance information is typically disclosed, for example, in Japanese Patent Laid-open Publication No. Sho 58-211191 or Sho 63-193192. In such sequencer-type automatic performance device, a set of initial setting control data for designating various characteristics of automatic performance tones such as a tone color, tone volume, tempo, effects etc. to be implemented during an automatic performance is contained or stored in the leading portion (namely, header portion) of the performance information, with various substantive performance data being sequentially stored after such initial setting control data. Therefore, in carrying out an automatic performance, the performance device first reads out the initial setting control data (hereinafter referred to as header control data) stored in the header portion, then actually sets up a tone color, tone volume, tempo, effect etc. to be implemented in the performance in conformity with the header control data, and subsequently reads out the substantive performance data so as to reproduce performance tones based thereon in accordance with the actually set-up tone color, tone volume, tempo, effects etc.

Because the header portion has such header control data representative of a tone color, tone volume, tempo, effect etc. stored therein, a tone color, tone volume, tempo, effect etc. to be actually implemented in an automatic performance can freely be changed to desired ones by rewriting the header control data or by changing the actually set-up control data entered in the automatic performance device. In order to carry out rewriting of the header control data stored in the header portion for this purpose, the automatic performance device is switched in its operation mode from the reproduction mode to the edit mode or the record-wait mode. Also, the set-up control data entered in the automatic performance device can freely be changed as desired even during a performance by operating panel switches etc.

However, the prior art automatic performance device is unsatisfactory in that the rewriting of the header control data stored in the header portion can not be done unless the on-going automatic performance is stopped to place the device into the edit mode or record-wait mode. Accordingly, even after the rewriting of the header control data has been completed, automatic performance processing must be carried out again in order to ascertain how performed tones will vary in accordance with the rewritten header control data. In other words, in order to obtain desired tones, it is necessary to alternately repeat the rewriting and reproduction operations of the header control data many times.

Further, in the prior art automatic performance device, setting of the various characteristics can freely be changed by changing the set-up data during a performance, and therefore it is possible to immediately ascertain how performed tones vary in accordance with the changed set-up data. Nonetheless, the changed set-up data are automatically erased in response to the termination of the automatic performance so that the previous set-up data are restored as they were before the change. Namely, the header control data record is left unchanged. Therefore, in order to rewrite the header control data of the header portion, it is necessary for the performer to personally make a note of values of the changed set-up data during a performance and then to rewrite the header control data while the device is in the edit mode or in the record-wait mode after the termination of the performance.

SUMMARY OF THE INVENTION

It is therefor an object of the invention to provide an automatic performance device which allows header control data to be rewritten in accordance with set-up data changed during an automatic performance.

An automatic performance device according to the present invention comprises: a storage section for storing performance data to be used for generating an automatic performance tone, and control data to be used for controlling various characteristics of the automatic performance tone, said control data being stored for shared use with individual portions of the performance data; a performance section for reading out the performance data from said storage section and generating an automatic performance tone, on the basis of read-out performance data; a control section for reading out the control data from said storage section and performing a control such that various characteristics of the automatic performance tone to be generated are determined on the basis of read-out control data; a change section for changing the control data to be used by said control section for determining the characteristics of the automatic performance tone; and a data rewriting section for rewriting said control data stored in said storage means, if the control data to be used by said control section is changed by said change section while reading the performance data by said performance section.

The control data are those data which are stored in a header portion, and the data are used for setting up or establishing various characteristics of an automatic performance tone to be generated, such as a tone color, tone volume, tempo, effect and the like. The performance data are those data which are used for generating an individual automatic performance tone, and the data include data for, for example, designating a tone-generation timing and tone pitch. The control data stored in the storage section in common to the individual performance data are read out by the control section, and on the basis of the thus read out control data, various characteristics of a tone to be generated are established. The performance data stored in the storage section are read out by the performance section, and on the basis of the thus read out performance data, an automatic performance tone is generated. In such case, various characteristics of the tone to be generated are established by the control section. The change section is provided for changing the various characteristics of the automatic performance tone established by the control section.

This change section allows the various characteristics of the automatic performance tone to be changed. Further, the data rewriting section is provided. When the characteristics of the automatic performance tone is changed by the change section, this data rewriting section operates to rewrite the control stored in the storage section, in accordance with the changed characteristics. Accordingly, with this arrangement, it is possible to freely change the various characteristics of the automatic performance tone during an automatic performance while listening to the generated tone, and it is also possible to automatically change control data stored in the storage section, in response to such change in the characteristics, with the result that operation of changing the control data can be performed in a simple manner. The selection section may be provided for selecting a mode for determining whether an automatic rewriting of the control data stored in the header portion should be allowed or not.

Now, the preferred embodiments of the present invention will be described in detail with reference to the accompanying drawings.

DESCRIPTION OF THE PREFERRED EMBODIMENTS

First of all, it is to be understood that although the present invention will be described below as being applied to an electronic musical instrument which carries out key depression and automatic performance processings by means of a single CPU, the present invention is also applicable to other electronic musical instruments in which a sequencer module for an automatic performance is provided separately from a module of a key-depression detecting circuit and a tone source circuit, and in which exchange of data between individual modules is done in accordance with the well-known MIDI (Musical Instrument Digital Interface) standard.

Figure 1:
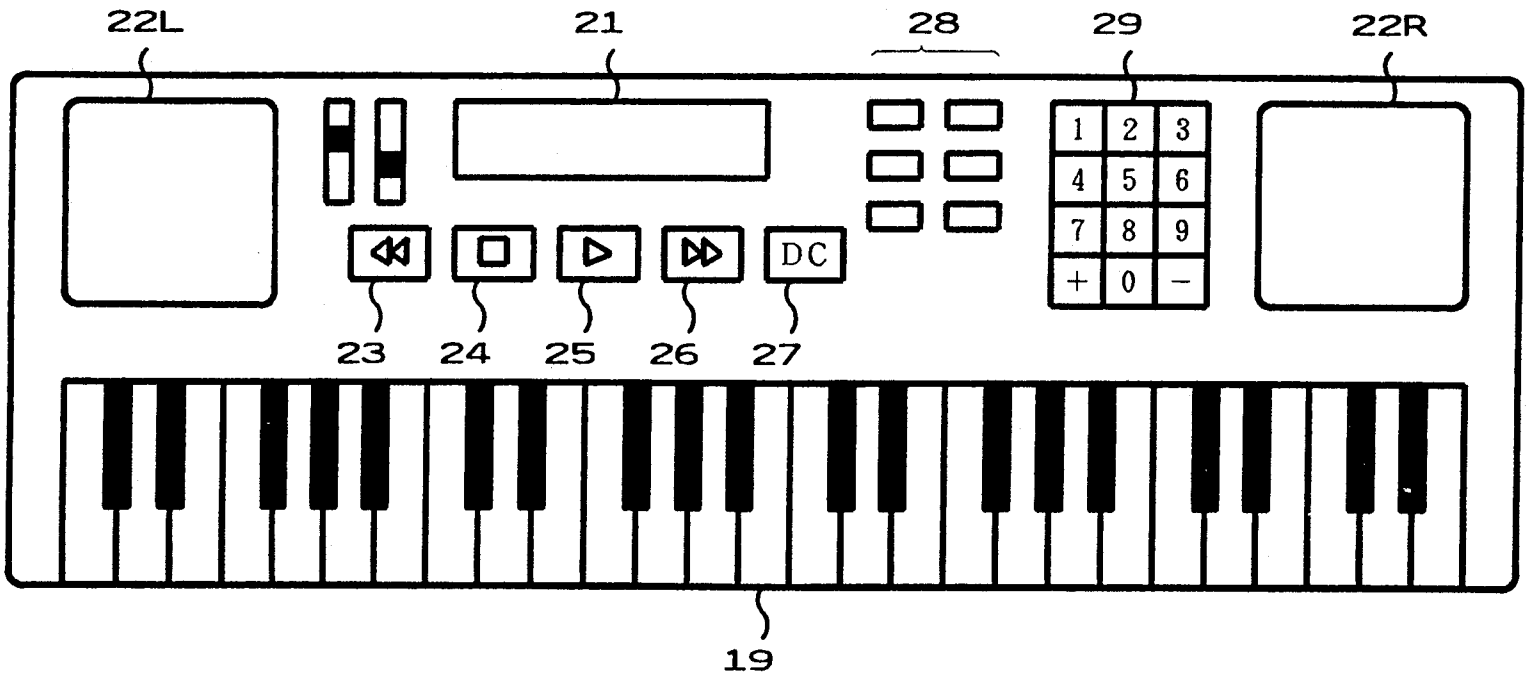
FIG. 1 is a schematic view illustrating an outer appearance of an electronic musical instrument which incorporates therein an automatic performance device of the sequencer type according to the invention.
Figure 2:
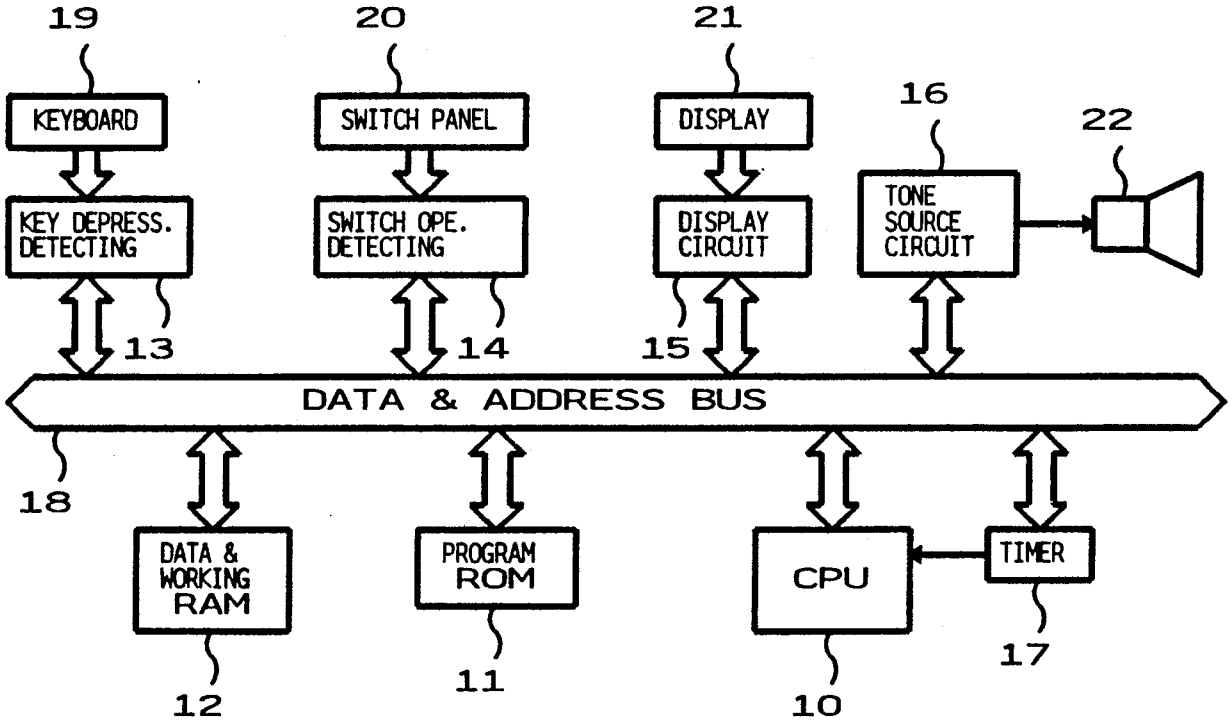
FIG. 2 is a block diagram of an overall hardware structure of the electronic musical instrument of FIG. 1.

FIG. 1 is a plan view illustrating a general outer appearance of an electronic musical instrument which incorporates therein an automatic performance device of the sequencer type. FIG. 2 is a block diagram illustrating an overall hardware structure of the electronic musical instrument of FIG. 1.

A microprocessor unit (CPU) 10 shown in FIG. 2 controls the entire functions of the electronic musical instrument. A program ROM 11, data and working RAM 12, key-depression detecting circuit 13, switch operation detecting circuit 14, display circuit 15, tone source circuit 16 and timer 17 are connected to the CPU 10 via a data and address bus 18. Those circuits are accommodated within the frame of the electronic musical instrument and hence are not shown in FIG. 1.

The program ROM 11 comprises a read-only memory (ROM) and has various programs and various data stored therein. The data and working RAM 12 temporarily stores performance information, as well as various data resulting as the CPU 10 executes the programs. This data and working RAM 12 is provided in a predetermined address region of a random access memory (RAM) and serves as various registers and flags to be described.

Figure 3:
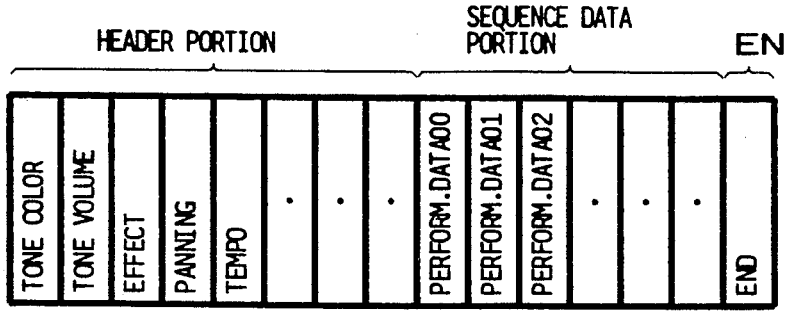
FIG. 3 conceptually shows performance information stored in the data and working RAM of FIG. 2.

FIG. 3 conceptually illustrates an example of performance information as stored in the data and working RAM 12. The performance information is generally composed of a header portion and a sequence data portion, and at the rearmost end thereof, end data EN is recorded to indicate the end of a performance. In the header portion, various characteristic-establishing data such as tone color data, tone volume data, panning data, tempo data etc. are recorded in a sequential manner. In the sequence data portion, performance data (event data) 00, 01, 02 corresponding to a music piece to be performed are recorded in a sequential manner.

The performance data are indicative of a performance sequence and are expressed, for example, in the standardized MIDI format. The performance data are sequentially recorded in line with actual performance procedure made by the performer, while the automatic performance device is operated in the recording mode. In the play mode, the individual contents of the thus-recorded performance data are sequentially read out in accordance with predetermined tempo clock signals. As such performance data, various data are recorded which are based on events detected by the key depression detecting circuit 13 and the switch operation detecting circuit 14. More specifically, key-on event data is recorded in response to a key depression, and key-off event data is recorded in response to a key release. Between the key-on and key-off event data, time data is recorded to indicate a time interval between the key-on and key-off events. The procedure for recording the automatic performance data will not be described further because it is a conventionally known matter.

A keyboard 19 has a plurality of keys for selecting a tone pitch of a tone to be generated and key switches provided in corresponding relation to the individual keys. In addition, the key board 19, has a key touch detecting section such as a key depression force detector as may be required. It will be appreciated that any other performance operators than the keyboard 19 may of course be employed.

The key depression detecting circuit 13 is composed of circuitry including plural key switches that correspond to the individual keys of the keyboard 19, so that it outputs key-on event data when a key is newly depressed by the performer and outputs key-off event data when a depressed key is released. In addition, the key depression detecting circuit 13 detects the velocity or force with which a key is depressed, so as to produce touch data, and then outputs the thus produced touch data as velocity data. Each of the key-on event data, key-off event data and velocity data are expressed in accordance with the MIDI standard and includes a key code as well as data indicative of a channel into which it is to be assigned. Instead of the key depression detecting circuit 13 and keyboard 19, a computer etc. may be employed for providing desired performance information.

The display circuit 15 serves to show on a display 21 various information such as the current control state of the CPU 10, the contents of various header control data etc. Operation of the display 21, which is preferably in the form of a liquid crystal display panel (LCD), is controlled by the display circuit 15.

A switch panel 20 has various operating elements for selecting, setting and controlling tone color, tone volume, musical effects etc. Among such operating elements are, as shown by way of example in FIG. 1, performance state control switches (including a fast-retreating switch 23, a stop switch 24, a play switch 25 and a fast-advancing switch 26), a data change reproduction switch (DC)27, setting switches 28 and ten-keys 29. Although not shown for convenience of description, there are provided other various switches on the switch panel 20.

The play switch 25 is a switch provided for initiating an automatic performance, whereas the stop switch 24 is provided for compulsorily stopping the automatic performance. The fast-retreating switch 23 is provided for rapidly retreating or backwardly moving the automatic performance, whereas the fast-advancing switch 26 is provided for rapidly advancing the automatic performance.

The data change reproduction switch (DC) 27 is a switch provided for rewriting the header control data of the header portion in accordance with set-up data changed during an automatic performance. Rewriting processing directed to this purpose will be described in detail later.

The setting switches 28 are provided in corresponding relation to tone color switches, tone volume switch, effect switches etc., for selecting the kind of set-up data to be changed. When any of the setting switches 28 is actuated which corresponds to the set-up data to be changed, currently-established values of the data are displayed on the display 21.

The ten-keys 29 are provided for changing the set-up data displayed on the display 21 and include plus-key (+) and minus-key (−). For example, if tone color data "001" currently displayed on the display 21 is changed to "099" by means of the ten-keys 29, new tone color data corresponding to "099" can be set up. Further, tone color data on the display 21 can be increased or decreased by operating the plus-key (+) and minus-key (−).

The tone source unit 16 is capable of simultaneously generating plural tone signals at plural channels. It receives performance information (information conforming to the MIDI standard) given via the data and address bus 18 and produces tone signals on the basis of the thus received performance information. In the tone source unit 16, any type of tone signal generation technique may be utilized. For example, any conventionally known techniques may be employed as may be necessary, such as the memory-read-out type in which tone waveshape sample value data stored in a waveshape memory are sequentially read out in accordance with address data changing in correspondence with the pitch of a tone to be generated, or the FM type in which tone waveshape sample value data are obtained by performing predetermined frequency modulation operations utilizing the above-mentioned address data as phase angle parameter data, or the AM type in which tone waveshape sample value data are obtained by performing predetermined amplitude modulation operations utilizing the above-mentioned address data as phase angle parameter data.

Tone signals generated from the tone source circuit 16 are audibly reproduced via a sound system 22 which comprises an amplifier (not shown) and speakers 22R and 22L, one speaker 22R for the right side channel, and the other for the left side channel.

The timer 17 generates a tempo clock pulse for counting a time interval and setting up an automatic performance tempo. The tempo clock pulse frequency can be determined and adjusted by a tempo switch, comprising one of the setting switches 28. The generated tempo clock pulse is supplied as an interrupt command signal to the CPU 10 so that the automatic performance processing may be performed as an interrupt processing.

Now, the operation of the automatic performance device of FIG. 2 which is carried out by the CPU 10 will be described in connection with flow charts as shown in FIGS. 4 to 8. Before going into such description of operation, various working registers and flags utilized in various processings will be set forth below. The following group of registers and flags are provided in the data and working RAM 12.

TC: Tempo clock register that is incremented by a timer interrupt processing for reading out the automatic performance data.

DCP: Data change play flag that is indicative of a mode at the reproduction time and that is rewritten by the activation of the data change reproduction switch 27. The data change play flag DCP indicates the data change reproduction mode by the value of "1", and the normal mode by the value of "0".

PLAY: Play flag that is indicative of a mode for an automatic performance. The play flag PLAY indicates the automatic performance mode by "1" and indicates the non-performance mode by "0".

CDATA: Change data register that has as many storage areas as the number of the header control data of the header portion and stores set-up data as changed by the setting switches 28 and ten-keys 29.

Figure 4:
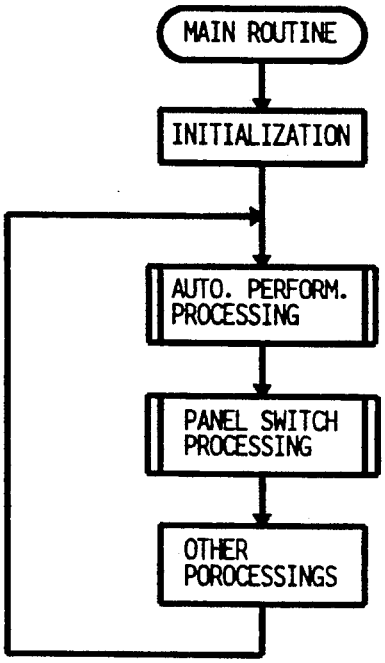
FIG. 4 is a flow chart of an example of the main routine carried out by the CPU of FIG. 2.

FIG. 4 illustrates an example of the main routine to be carried out by the CPU 10.

Upon activation of the power supply source, the CPU 10 initiates processings which correspond to the control program stored in the program ROM 11. In the "initialization" processing, the aforementioned registers and flags provided within the data and working RAM 12 are initialized. Thereafter, the "automatic performance processing", "panel switch processing" and "other processings" are repetitively carried out in response to detection of corresponding events.

Figure 6:
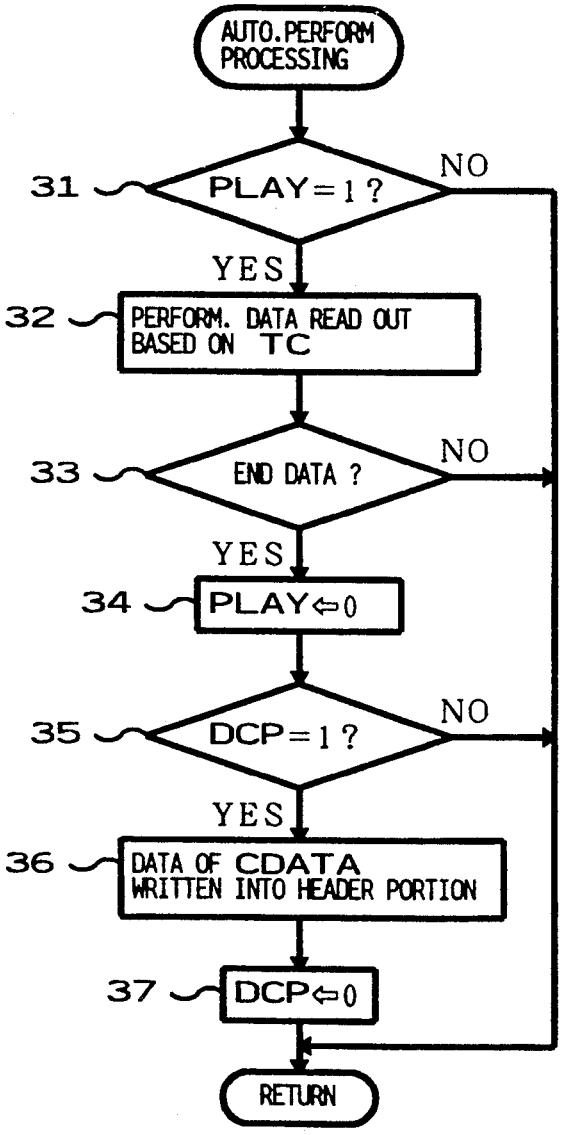
FIG. 6 is a flow chart of a detailed example of the automatic performance processing of FIG. 4.
Figure 7:
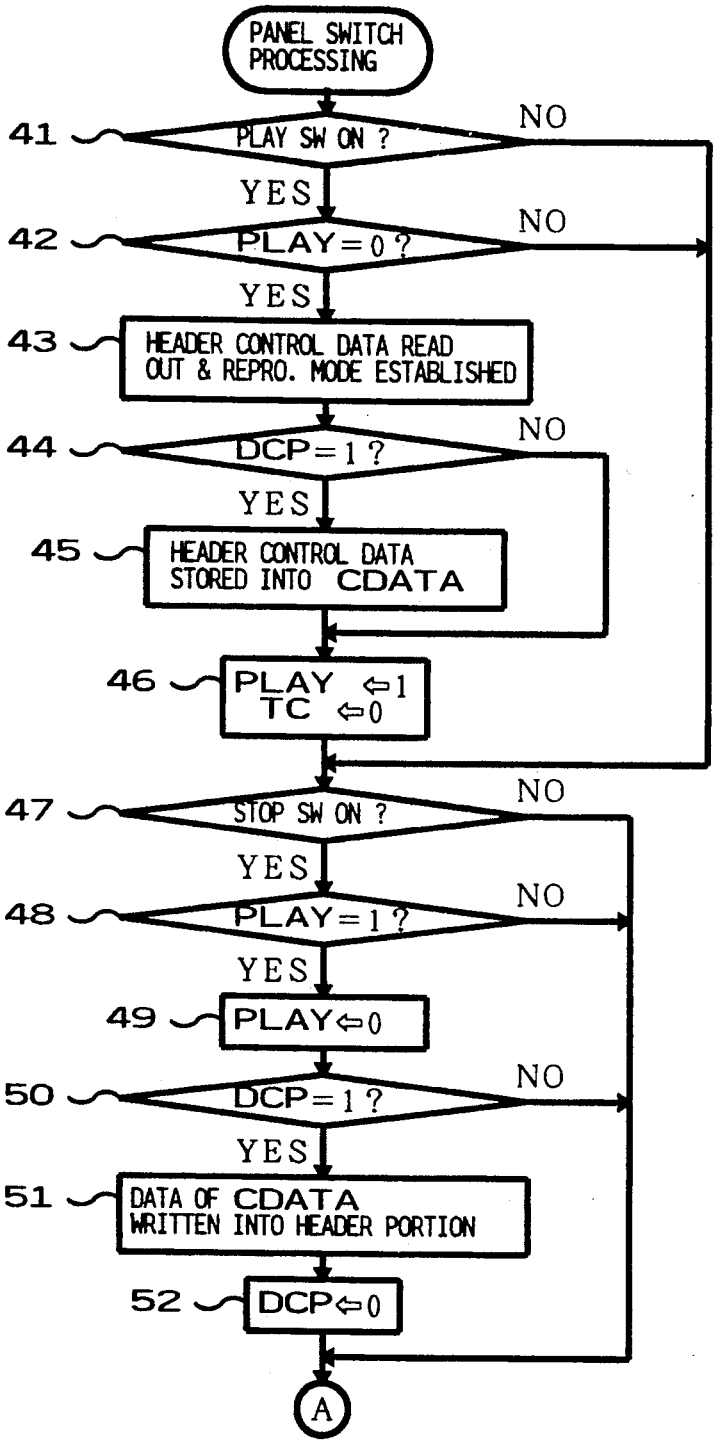
FIG. 7 is a flow chart of the first half of the panel switch processing of FIG. 4.
Figure 8:
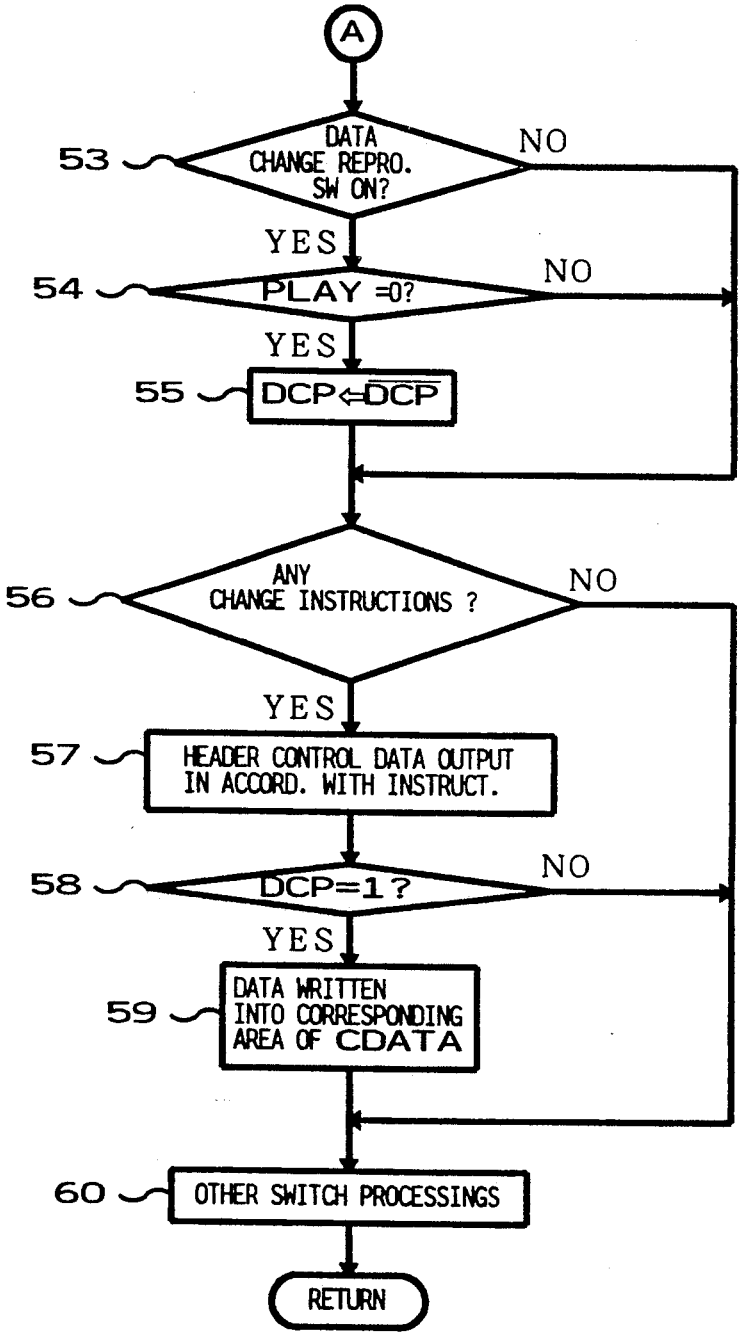
FIG. 8 is a flow chart of the second half of the panel switch processing of FIG. 4.

The "automatic performance processing", a detailed example of which is illustrated in FIG. 6, is initiated when the play switch 25 of the switch panel 20 is activated. The "panel switch processing", a detailed example of which is illustrated in FIGS. 7 and 8, is initiated when the performance state control switches (fast-retreating switch 23, stop switch 24, play switch 25 and fast-advancing switch 26), data change reproduction switch 27, setting switches 28 and ten-keys 29 are activated. In the "other processings", processes based on operations of other operating elements of the panel switch 20, or various other processes are performed.

Figure 5:
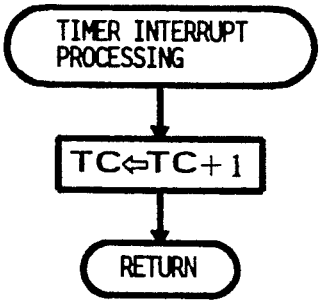
FIG. 5 is a flow chart of an example of the timer interrupt processing carried out by the CPU each time a tempo clock pulse is given to the CPU.

FIG. 5 shows the time interrupt processing that is carried out each time a tempo clock pulse is given to the CPU 10. In this processing, the tempo clock register TC is incremented at each timer interrupt timing. The incremented value of the tempo clock register TC is utilized for reading out performance data at the time of an automatic performance.

Next, each step of the "automatic performance processing" will be described with reference to FIG. 6.

Step 31: It is determined whether the play flag PLAY is "1" or not. If the determination result is "1", this means that the play switch 23 is in the ON state (indicating the reproduction mode), and hence the processes of succeeding steps 32 to 37 are performed. In the case of the record or stop mode other than the reproduction mode (i.e., if the determination result is NO), the program returns to the main routine.

Step 32: Because the period of the increment processing is sufficiently greater than the period of the automatic performance, the value of the tempo clock register TC often appears in the same or unchanged value in this step. Accordingly, in this step, only when the value of the tempo clock register TC coincides with the tone generation timing of any performance data of FIG. 3 is the performance data read out. When the value of the tempo clock register TC does not coincide with the tone generation timing of any performance data, the program advances to steps 33 to 37. Namely, performance data corresponding to the value of the tempo clock register TC are sequentially read out.

Step 33: It is determined whether or not the performance data read out in step 32 is end data EN of FIG. 3. If the data is end data (namely, YES), the program advances to the next step. If not, the program returns to the main routine so that steps 31 and 32 of FIG. 6 may be repeated.

Step 34: Because the performance data read out in step 32 is end data, "0" is stored in the play flag PLAY to enter the stop mode.

Step 35: It is determined whether or not the data change play flag DCP is "1". If it is "1" (YES), the next step 36 is taken, whereas if it is "0" (NO), the program returns to the main routine.

Step 36: Data stored in the change data register CDATA is written as a new header control data record into the header portion shown in FIG. 3.

Step 37: "0" is set into the data change play flag DCP, and the automatic performance processing and header portion rewriting process are terminated.

As will be appreciated from the aforementioned description of steps 31 to 37, by activating the data change reproduction switch 27 and also setting the data change play flag DCP to 1, the header control data of the header portion can be rewritten in conformity with the contents of the change data register CDATA at the time when the automatic performance processing is terminated.

Next, the "panel switch processing" of FIG. 4 will be described in detail with reference to FIGS. 7 and 8.

The steps 41 to 46 are carried out in response to the activation of the play switch 25 of the switch panel 20.

Step 41: It is determined whether or not the play switch 25 of the switch panel 20 is activated. If the determination result is YES, the next step 42 is taken. If the determination result is NO, the program jumps to step 47 to perform processes corresponding to activation of other switches.

Step 42: It is determined whether or not the play flag PLAY is "0". The program advances to the next step 43 if the result is "0" (YES), whereas the program jumps to the step 47 if the result is not "0" (NO). Namely, if the play flag PLAY is determined to be "1" in this step, it is meant that the play switch 25 has been activated (turned on) again during the reproduction mode (during the automatic performance processing), and so in this case, the program jumps to step 47 to make ineffective such activation of the play switch 25.

Step 43: Because it has been determined in step 42 that the play flag is "0", namely that the automatic performance processing is not currently being performed, the header control data is read out from the header portion to perform the automatic performance processing, and the reproduction mode of the electronic musical instrument is established on the basis of the read-out header control data.

Step 44: Whether or not the data change play flag DCP is "1" is determined. If the result is YES, the program advances to step 45. If the result is "0", namely NO, the program jumps to step 46.

Step 45: Because the data change play flag DCP is "1", the header control data of the header portion is stored in the change data register CDATA. Therefore, when the contents of the header control data are thereafter changed by the actuation of the setting switches 28 and ten-keys 29, only some of the header control data in the change data register CDATA which correspond to the change need to be rewritten. The rewritten header control data is entered as new header control data into the header portion in step 51 or step 36 of FIG. 6.

Step 46: The play flag PLAY is set to "1" to show that the reproduction mode goes on thereafter, and the tempo clock register TC is reset to "0" to allow the performance information to be sequentially read out all over again.

The following steps 45 to 52 are performed in response to the activation of the stop switch 24 of the switch panel 20. Namely, the steps 45 to 52 are performed in the case where performance is compulsorily stopped during the reproduction mode (automatic performance), and these steps are the same as the steps 34 to 37 shown in FIG. 6.

Step 47: It is determined whether the stop switch 24 is activated (turned on). The next step 48 is taken if the result is YES. If the result is NO, then the program jumps to step 53 of FIG. 8 via conjunction mark A.

Step 48: Whether the play flag PLAY is "1" or not is determined. If the result is YES, the program advances to next 49, and if the result is NO, the program jumps to step 53 of FIG. 8 via conjunction mark A. Namely, the determination in this step that the play flag PLAY is "0" corresponds to the case where the stop switch 24 has been again activated during the stop mode (during non-performance time) which is different from the reproduction mode, and so in this case, the program jumps to step 53 to make ineffective the activation of the stop switch 24.

Step 49: "0" is set into the play flag PLAY to show that the stop mode is thereafter effective.

Step 50: Whether or not the data change play flag DCP is "1" is determined. If the result is YES, the program advances to step 51, and if the result is NO, the program jumps to step 53 of FIG. 8 via the conjunction mark A.

Step 51: Because the data change play flag DCP has been determined to be "1" in step 50, the header control data changed by the setting switches 28 and ten-keys 29 are written as new header control data into the header portion. Namely, since the data changed by the setting switches 28 and ten-keys 29 have been stored in the change data register CDATA, the contents of the register CDATA are written as new header control data.

Step 52: "0" is set into the data change play flag DCP, and the data change reproduction switch 27 is reset to an initial state.

The steps 53 to 55 are performed in response to activation of the data change switch 27 of the switch panel 20.

Step 53: It is determined whether the data change reproduction switch 27 is activated or not. If the determination result is YES, the program advances to the next step 54, and if the result is NO, the program jumps to the step 56.

Step 54: It is determined whether or not the play flag PLAY is "0". If the result is YES, the program advances to the next step 55, and if the result is NO, the program jumps to the step 56. Namely, the determination in this step that the play flag PLAY is "1" corresponds to the case where the data change reproduction switch 27 is activated during the normal mode (during an automatic performance), and so in this case, the program jumps to step 56 to make ineffective the activation of the data change switch 27.

Step 55: The data change flag DCP is inverted each time the data change reproduction switch 27 is activated. Namely, if the data change flag DCP is "0", it is inverted to "1", and if the data change flag DCP is "1", it is inverted to "0". This step is a step which becomes effective only when the play flag is "0" and is ignored during the reproduction mode (during an automatic performance). Whether the data change play flag DCP is "0" or "1" is displayed by means of an LED (not shown) mounted above or below or on the data change reproduction switch 27.

The following steps 56 to 59 are performed in response to activation of the setting switches 28 and ten-keys 29 of the switch panel 20.

Step 56: It is determined whether or not header control data change instruction is made via the setting switches 28 and ten-keys 29. If there is such instruction (YES), the program advances to the next step 57 to execute header control data change processing. If there is no such instructions (NO), the program jumps to step 60.

Step 57: Header control data are output which correspond to the header control data change instructions so that predetermined data may be rewritten in step 43.

Step 58: Whether or not the data change play flag DCP is "1" is determined. If the determination result is YES, the program advances to step 59, and if the result is NO, the program jumps to step 60.

Step 59: Header control data associated to the header control data change instructions made by the switches 28 and ten-keys 29 are written into corresponding areas of the change data register CDATA.

Step 60: Other switch processings other than the above-mentioned are carried out.

Next, an outline of the processing shown in FIGS. 7 and 8 will be set forth.

First, before going to the automatic performance processing, the data change reproduction switch 27 is activated depending on whether the header control data should be changed. Then, by steps 53 through 55, the data change play flag DCP is set to "0" or "1". Next, when the play switch 25 is activated to initiate an automatic performance, steps 41 to 46 are executed so that the header control data of the header portion is established within the electronic musical instrument, and the same header control data record is also stored in the change data register CDATA. In addition, the play flag PLAY is set to "1", and the tempo clock register TC is reset. Thus, the electronic musical instrument performs the automatic performance processing.

When the header control data are changed by the operation of the setting switches 28 and ten-keys 29, steps 56 to 59 are executed so that the changed header control data are also written into the change data register CDATA. Each time the header control data are changed, steps 56 to 59 are executed, and the new header control data are stored into the change data register CDATA.

Then, when the stop switch 24 is turned on, the automatic performance processing is stopped compulsorily, and steps 47 to 52 are executed so that the header control data in the change data register CDATA are written into the header portion. Alternatively, when end data EN appears in the performance data, the automatic performance processing is terminated, and steps 33 to 37 are executed so that the header control data in the change data register CDATA are written into the header portion. In this manner, the header control data as changed during the automatic performance are written into the header portion as new header control data, and thereafter the changed header control data are established within the electronic musical instrument in each reproduction mode.

Although in the above-described embodiment, the header control data record of the header portion is rewritten when the set-up control data are changed during the reproduction mode (during an automatic performance), it goes without saying that the control data in the header portion may be changed if necessary even when the set-up control data are changed during the stop mode (during the non-performance period).

Further, although it has been stated in the foregoing description of the embodiment that the activation of the data change reproduction switch 27 is effective only during the stop mode (during non-performance period), alternative arrangements may be adopted such that the aforementioned step 54 is omitted, and the contents of the data change play flag DCP can be changed at any time by activating the data change reproduction switch 27.

Moreover, alternative arrangements may be employed such that the aforementioned step 58 is omitted, and the contents of the change data register CDATA is rewritten whenever change instruction is made via the setting switches 28 and ten-keys 29. Even in this case, there will arise no serious problem because determination is made in step 35 or 50 as to whether the header control data of the header portion should be rewritten before going to step 36 or 51 for writing the contents of the change data register CDATA into the header portion.

Furthermore, although it has been stated in the foregoing description of the embodiment that even if the contents of the change data register CDATA is not changed via the setting switches 28 and ten-keys 29, the contents of the change data register CDATA is written into the header portion as long as the data change play flag DCP is "1", alternative arrangements may be employed such that a change flag is provided, and the contents of the header portion is rewritten only when the contents of the change data register CDAT has been rewritten.

Furthermore, although the change data register CDATA has been described as having as many storage areas as the number of the header control data, there may be allocated sufficient storage areas for sequentially storing a history of the header control data change performed by the setting switches 28 and ten-keys 29, so that the header control data can freely be changed in accordance with the history after the termination of an automatic performance.

Furthermore, although description has been made of the case where the changed set-up data are written into the header portion after the termination of an automatic performance, a canceling function may further be added such that the changed data can be brought back to their previous state after having been written into the header portion. For example, in such alternative arrangements, the data of the header portion is copied into another storage area (temporary reserve memory) when the data change reproduction mode is initiated, and the initial header control data stored in still another storage area is written into the header portion in response to the depression of a cancellation switch after the reproduction has been terminated and the data has been rewritten. Further, the data may be rewritten again in accordance with the above-mentioned data change history. In such case, the cancellation switch may be provided on the switch panel 20, and the reserve memory may be provided in the RAM 12.

As has been set forth, according to the present invention, the contents of header control data in a header portion can be rewritten simply by changing set-up data while listening to performed tones during an automatic performance. As the result, the invention achieves the advantage of allowing change of header control data to be performed simply and easily.

What is claimed is:

1. An automatic performance device which comprises:

storage means for storing performance data to be used for generating an automatic performance tone, and control data to be used for controlling various characteristics of the automatic performance tone, said control data being stored for shared use with individual portions of the performance data;

performance means for reading out the performance data from said storage means and generating an automatic performance tone, on the basis of read-out performance data;

control means for reading out the control data from said storage means and performing a control such that various characteristics of the automatic performance tone to be generated are determined on the basis of read-out control data;

change means for changing the control data to be used by said control means for determining the characteristics of the automatic performance tone; and data rewriting means for rewriting said control data stored in said storage means, if the control data to be used by said control means is changed by said change means while reading the performance data by said performance means.

2. An automatic performance device as defined in claim 1, in which said control means includes a buffer memory for storing the control data read out from said storage means and determines the various characteristics of the automatic performance tone to be generated, on the basis of the control data stored in the buffer memory, wherein said change means includes operator means for setting various characteristics such as tone color, tone volume, tempo or effect and changes the control data stored in said buffer memory in response to operation of said operator means, and wherein said data rewriting means rewrites the control data stored in said storage means by transferring the control data stored in said buffer memory to said storage means.

3. An automatic performance device as defined in claim 2, in which said data rewriting means transfers the control data stored in said buffer memory to said storage means, when an automatic performance is terminated.

4. An automatic performance device as defined in claim 1, in which the performance data includes end data, and the performance means stops automatic performance by reading out the end data.

5. An automatic performance device as defined in claim 1, which further comprises stop means for instructing said performance means to stop automatic performance.

6. An automatic performance device as defined in claim 1, in which said storage means has a header data area and a performance data area, the control data being stored in the header data area.

7. An automatic performance device as defined in claim 1, which further comprises selection means for determining whether a mode for rewriting the control data should be selected or not, and said data rewriting means rewrites the control data stored in said storage means on the condition that the mode for rewriting the control data is selected by said selection means.

8. An automatic performance device as defined in claim 1, in which said performance data comprises data for an automatic sequence performance.

9. An automatic performance device as defined in claim 1, in which said performance data comprises data for an automatic rhythm performance.

10. An automatic performance device as defined in claim 1, in which said performance data comprises data for an automatic accompaniment performance.

11. An automatic performance device as defined in claim 1, which further comprises cancelling means for nullifying rewriting by said data rewriting means of the control data stored in said storage means.

12. An automatic performance device as defined in claim 11, in which said cancelling means includes a reserve memory for reserving the control data stored in said storage means before the control data is rewritten by said data rewriting means, a cancelling switch, and write-control means responsive to an activation of said cancelling switch for writing into said storage means the control data reserved in said reserve memory.

* * * * *